US012104610B2

(12) United States Patent
Xie et al.

(10) Patent No.: US 12,104,610 B2
(45) Date of Patent: Oct. 1, 2024

(54) COMBINED FAN STRUCTURE

(71) Applicant: SHENZHEN YONGYIHAO ELECTRONICS CO., LTD., Guangdong (CN)

(72) Inventors: Zixing Xie, Guangdong (CN); Yong Wang, Guangdong (CN)

(73) Assignee: SHENZHEN YONGYIHAO ELECTRONICS CO., LTD, Shenzhen (CN)

( * ) Notice: Subject to any disclaimer, the term of this patent is extended or adjusted under 35 U.S.C. 154(b) by 0 days.

(21) Appl. No.: 18/520,504

(22) Filed: Nov. 27, 2023

(65) Prior Publication Data

US 2024/0151235 A1 May 9, 2024

Related U.S. Application Data

(63) Continuation of application No. PCT/CN2022/138746, filed on Dec. 13, 2022.

(30) Foreign Application Priority Data

Aug. 11, 2022 (CN) ..... 202210966864.3

(51) Int. Cl.
*F04D 25/16* (2006.01)
*F04D 25/06* (2006.01)
*F04D 29/64* (2006.01)

(52) U.S. Cl.
CPC ..... *F04D 25/166* (2013.01); *F04D 25/0693* (2013.01); *F04D 29/64* (2013.01)

(58) Field of Classification Search
CPC ..... F04D 25/166; F04D 25/0693; F04D 29/64
See application file for complete search history.

(56) References Cited

U.S. PATENT DOCUMENTS

2007/0041857 A1* 2/2007 Fleig ..... F04D 25/0613 310/67 R
2007/0280840 A1* 12/2007 Sugiyama ..... F04D 25/0613 417/423.5

(Continued)

FOREIGN PATENT DOCUMENTS

CN 1877130 A 12/2006
CN 209471419 U 10/2019

(Continued)

*Primary Examiner* — Aaron R Eastman

(57) ABSTRACT

A combined fan structure includes sub-fans and a connector connected between two adjacent sub-fans, the sub-fan includes an impeller mounting shell and an impeller assembly mounted on the impeller mounting shell, each of two sidewalls of the impeller mounting shell away from each other is respectively configured with two sockets, two sidewalls of the two sockets away from each other are each configured with an insertion opening configured for the connector to be inserted into, two sidewalls of the socket adjacent to the insertion opening are respectively configured with a limiting bar, a limiting channel is formed between the limiting bar and a bottom of the socket, the limiting channel is in communication with the insertion opening; a snapping groove is defined at the bottom of the socket, when the connecting plate body is inserted in the socket, the hook is snapped in the snapping groove.

8 Claims, 7 Drawing Sheets

(56) References Cited

U.S. PATENT DOCUMENTS

| | | | | |
|---|---|---|---|---|
| 2013/0039783 | A1* | 2/2013 | Wagner | F04D 29/059 417/313 |
| 2014/0056742 | A1* | 2/2014 | Nakamura | F04D 25/0613 417/423.14 |
| 2018/0252224 | A1* | 9/2018 | Yamasaki | H02K 7/14 |
| 2018/0369705 | A1* | 12/2018 | Tiffin | A63H 18/02 |
| 2020/0284264 | A1* | 9/2020 | Deng | F04D 19/002 |

FOREIGN PATENT DOCUMENTS

| | | | |
|---|---|---|---|
| CN | 215601730 | U | 1/2022 |
| CN | 216648703 | U | 5/2022 |
| CN | 115342074 | A | 11/2022 |

* cited by examiner

A

COMBINED FAN STRUCTURE

CROSS-REFERENCE TO RELATED APPLICATION

This application is a continuation of PCT application serial No. PCT/CN2022/138746, filed on Dec. 13, 2022, which claims the priority and benefit of Chinese patent application serial No. 202210966864.3, filed on Aug. 11, 2022. The entirety of the above-mentioned patent applications are hereby incorporated by reference herein and made a part of this specification.

TECHNICAL FIELD

The present application relates to the field of combined fan, and, in particular, to a combined fan structure.

BACKGROUND ART

Air cooling is generally used in the heat dissipation of desktop computer mainframe. The heat energy generated by the processor, graphics card and other hardware in the computer mainframe is discharged in time through the cooling fan, so as to ensure the normal and efficient operation of the computer. However, the hardwares with different configuration in the computer mainframe have different cooling requirements. As the configuration of hardware is constantly updated, the fans used for cooling of computer mainframe must be updated with upgrading of hardware configuration, in order to meet the cooling requirements of the hardware.

In order to improve the cooling effect of the fan and reduce noise, a plurality of fans are often used. In the related art, the fans of computer mainframe are usually mounted in such a way, that a plurality of small fans are fixedly mounted together on a fan carrier and the circuit between the plurality of fans is closed to form a combined fan. Then this combined fan is mounted in the computer mainframe.

Regarding to the above-mentioned related art, the inventor believes that after replacing the hardware in computer mainframe, the cooling requirements also change accordingly. However, number of fans of the combined fan is fixed and the individual fans are difficult to disassemble and assemble, therefore, the combined fan must be replaced entirely, which increases the cost.

SUMMARY

In order to realize a combination of different numbers of fans according to actual demand, the present application provides a combined fan structure.

The combined fan structure disclosed includes a plurality of sub-fans and a connector connected between each two adjacent sub-fans of the plurality of sub-fans, wherein each of the plurality of sub-fans includes an impeller mounting shell and an impeller assembly mounted on the impeller mounting shell, each of two sidewalls of the impeller mounting shell away from each other is respectively configured with two sockets, two ends of the impeller mounting shell at each of the two sidewalls of the impeller mounting shell each are respectively configured with one of the two sockets, two sidewalls of the two sockets away from each other are each configured with an insertion opening configured for the connector to be inserted into the insertion opening of a respective one of the two sockets, two sidewalls of each of the two sockets adjacent to the insertion opening are respectively configured with a limiting bar, a limiting channel is formed between the limiting bar and a bottom of each of the two sockets, and the limiting channel is in communication with the insertion opening;

A snapping groove is defined at the bottom of each of the two sockets, the connector includes a connecting plate body and two elastic stoppers on the connecting plate body, two ends of the connecting plate body away from each other are respectively configured with an operating hole, each of the two elastic stoppers includes an elastic flap and a hook connected to the elastic flap, a first end of the elastic flap is connected to a wall of the operating hole, the hook is disposed at a second end of the elastic flap and extends out of the operating hole, and when the connecting plate body is inserted in a respective one of the two sockets, the hook can be snapped in the snapping groove.

According to the above technical solution, an end of the connector is inserted into a socket through a respective insertion opening of one of the sub-fans, wherein two sides of the connector are inserted in two limiting channels. On the one hand, the limiting bars guide the sliding of the connector, on the other hand, the limiting bars prevent the connector from sliding out of the opening of the socket. When the connector slides in the socket, the hook slidingly abuts against the bottom of the socket and pushes the elastic flap in a direction away from the socket, such that the elastic flap is elastically deformed and stores elastic potential energy. When the hook moves to the snapping groove, the elastic flap releases the elastic potential energy, such that the hook is snapped into the snapping groove. The hook is matched with the snapping groove, so as to fix the end of the connector in the socket. Another connector is inserted and fixed in another socket at the other sidewall and at the same end of the impeller mounting shell in the same way, and then the two connectors fixed on this sub-fan are respectively inserted and fixed in two sockets of another sub-fan, wherein the insertion openings of the two sockets are open to the same side, thereby realizing the joint of two sub-fans. A plurality of sub-fans can be connected in sequence to form a combined fan by repeating the above steps for many times. When the elastic flap is manually bent in a direction away from the bottom of the socket through the operating opening, the hook is pulled out from the snapping groove, so as to pull the connector out from the socket, so that one sub-fan can be detached from another sub-fan. The combination of different numbers of fans according to actual needs can therefore be easily realized.

Optionally, the impeller mounting shell includes an inner mounting bracket and an outer mounting housing, the impeller assembly is disposed on the inner mounting bracket, the two sockets are defined at the outer mounting housing, the outer mounting housing is configured with a mounting hole, the inner mounting bracket is arranged in the mounting hole, the inner mounting bracket is connected to an inner wall of the mounting hole through a plurality of connecting blocks, and a closed and communicated wiring channel is formed between a circumferential surface of the inner mounting bracket and the inner wall of the mounting hole.

According to the above technical solution, the wire for connecting a sub-fan to operate can be wound in the wiring channel, so that the entire combined fan structure is neater compared with the external wiring of the impeller mounting shell. The connecting blocks connect the inner mounting bracket and the outer mounting housing, while supporting and protecting the wires in the wiring channel.

Optionally, a wire through hole is defined at the bottom of each of the two sockets, the wire through hole is in communication with the closed and communicating wiring channel, the connecting plate body is configured with a PCB mounting groove, the PCB mounting groove and the hook are arranged on a surface at a same side of the connecting plate body, and when two of the plurality of sub-fans are connected through the connector, two of the wire through holes in the two of the plurality of sub-fans are in communication with the PCB mounting groove.

According to the above technical solution, the wire in the wiring channel can extend to the socket through the wire through hole. The wire directly enters the wire through hole in another sub-fan through the PCB mounting groove and is connected with the wire of the another sub-fan, so as to realize a circuit connection between the two sub-fans. The connecting wires are covered in the connector and are not exposed, so that the combined fan structure is neater. Alternatively, a connection terminal can be pre-mounted at the wire through hole, wherein the first end of the connection terminal is connected to the wire in the wiring channel, and the second end thereof extends into the socket. A PCB board for circuit connection can be mounted in the PCB mounting groove. When the two sub-fans are connected with each other through the connector, the PCB board mounted in the PCB mounting groove contacts the connecting terminal wires mounted on the two sub-fans simultaneously, so as to realize a circuit connection between the two sub-fans, so that the circuit connection between the two sub-fans is simple and fast.

Optionally, a blocking element is arranged in the closed and communicated wiring channel, the blocking element is clamped between the inner mounting bracket and the inner wall of the mounting hole, and the blocking element is configured to seal an opening of the closed and communicated wiring channel close to hole-openings on two sides of the mounting hole.

According to the above technical solution, dust and water stains are not easy to enter the wiring channel to pollute and corrode the wires in the wiring channel, which further improves the protection effect on the wires and the integrity of the sub-fan, such that the overall appearance of the sub-fan looks better.

Optionally, the blocking element is configured as a lampshade in the closed and communicated wiring channel, and the lampshade is clamped between the inner mounting bracket and the inner wall of the mounting hole.

According to the above technical solution, luminous light strips can be mounted in the wiring space. The lampshade protects the luminous light strips and wires in the wiring channel, and at the same time, the light emitted by the luminous light strips located in the wiring channel can pass through the lampshade to decorate the sub-fan.

Optionally, the blocking element is configured with a plurality of insertion notches, and a sectional shape of each of the plurality of insertion notches is adaptive for each of the plurality of connecting blocks.

According to the above technical solution, when the blocking element is mounted in the wiring channel, the plurality of insertion notches in the blocking element are engaged with the plurality of connecting blocks one by one, so that the lampshade is more stably mounted in such a way, that the connecting blocks limit the sliding of the lampshade in the wiring channel.

Optionally, the outer mounting housing is configured with an accommodation chamber close to a respective one of the two sockets, the wire through hole is in communication with the accommodation chamber, and a sidewall of the accommodation chamber close to the closed and communicated wiring channel is configured with a communicating hole in communication with the closed and communicated wiring channel.

According to the above technical solution, the wires in the wiring channel can enter the accommodation chamber through the communicating hole. The accommodation chamber provides a mounting space for adapters, conductive terminal wires or other control elements that connect the circuits of two sub-fans, so as to improve the space utilization inside the outer mounting housing, and at the same time, the outer mounting housing also protects the elements in the accommodation chamber.

Optionally, the inner mounting bracket includes an outer mounting frame and a mounting seat disposed in the outer mounting frame, the impeller assembly is arranged on the mounting seat and located inside the outer mounting frame, an outer sidewall of the outer mounting frame is connected to the outer mounting housing through the plurality of connecting blocks, a wire bridge is disposed between the mounting seat and the outer mounting frame, the wire bridge is configured with a wire channel, the outer mounting frame is configured with a wire hole, an opening at an end of the wire hole is in communication with the closed and communicated wiring channel, an end of the wire channel close to the outer mounting frame is in communication with the wire hole.

According to the above technical solution, the wire for connecting the impeller assembly to operate can enter the wiring channel through the wire through hole in a sub-fan, and enter the wire channel through the wire hole and is connected to the impeller assembly, which minimizes the exposure of the wires, so that the overall beauty of the appearance of the sub-fan is guaranteed, the wire is protected, and the difficulty in mounting of the sub-fan due to the messy external wires is reduced.

Optionally, the impeller mounting shell is configured with a plurality of screw holes.

According to the above technical solution, it is convenient to install the jointed combined fan at the corresponding position in the computer mainframe through screws.

DETAILED DESCRIPTION

The present application will be described in further detail below with reference to FIGS. 1-7.

Figure 1:
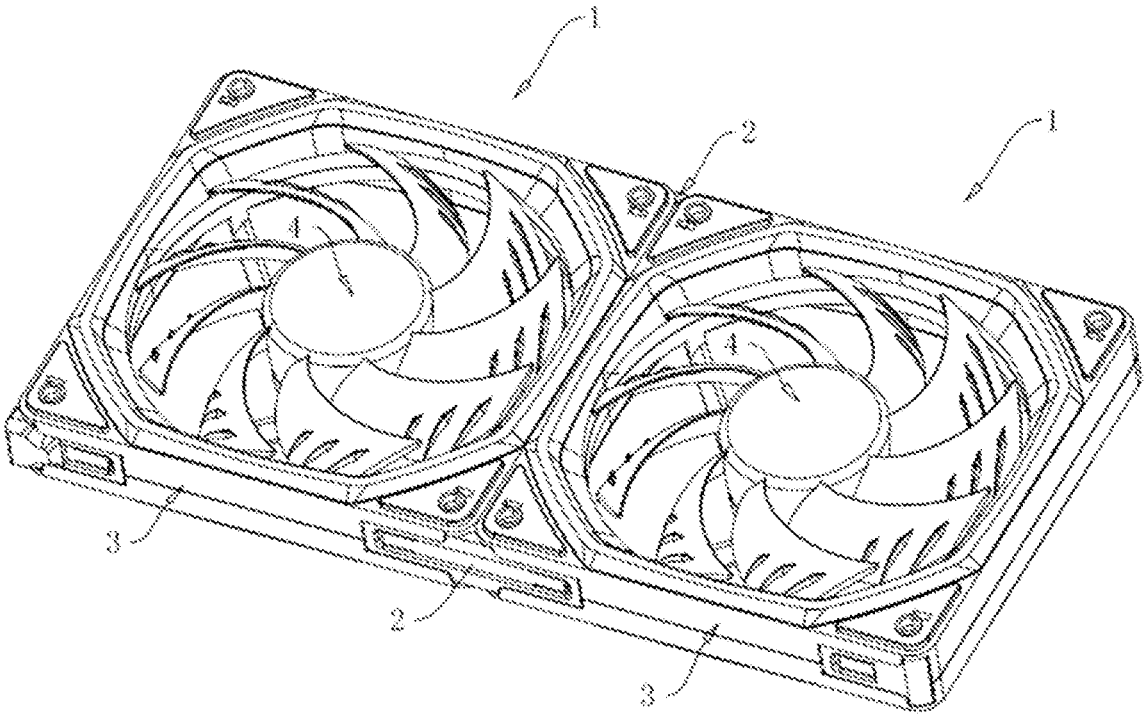
FIG. 1 is a schematic view of the combined fan structure of the present application.

The embodiment of the present application discloses a combined fan structure. Referring to FIG. 1, the combined fan structure includes two sub-fans 1 and a connector 2 between the two adjacent sub-fans 1. The sub-fan 1 includes an impeller mounting shell 3 and an impeller assembly 4 on the impeller mounting shell 3. The impeller assembly 4 drives the impeller to rotate through a motor fixed on the impeller mounting shell 3.

Figure 2:
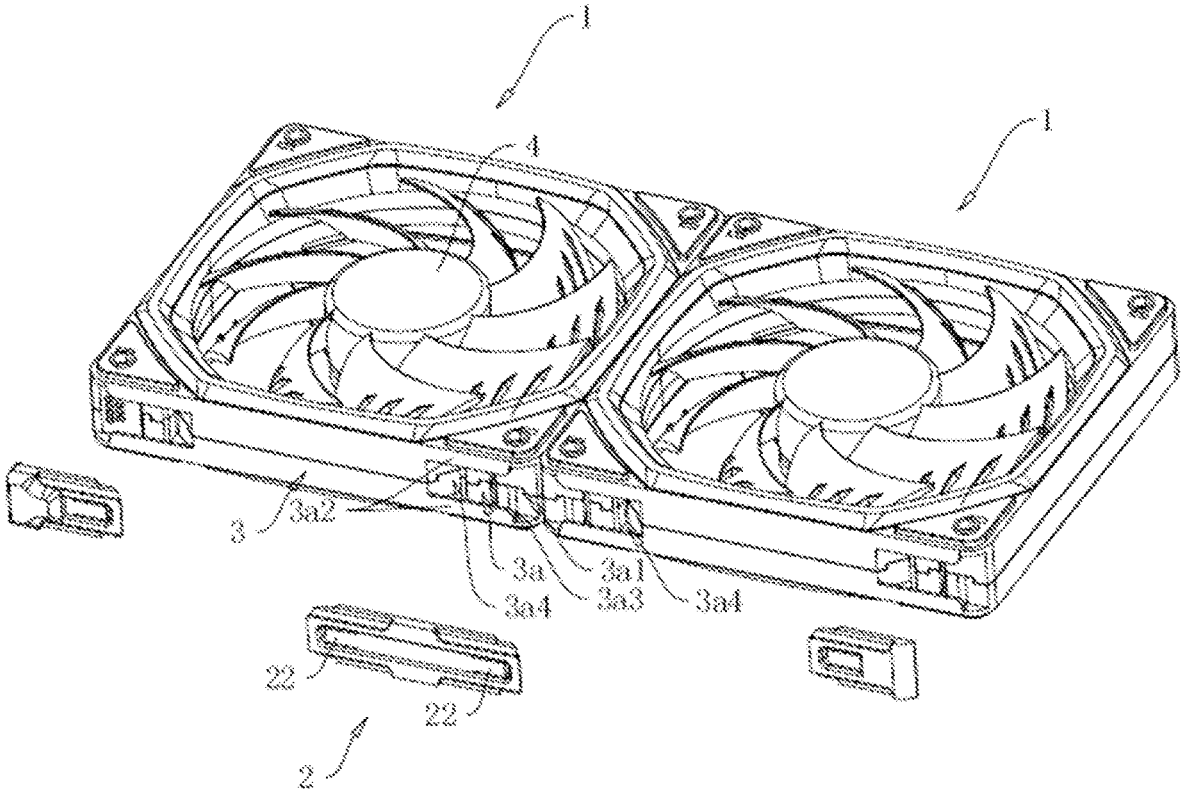
FIG. 2 is a schematic view highlighting the socket in the combined fan structure of the present application.

Referring to FIG. 1 and FIG. 2, the impeller mounting shell 3 has a square sectional shape. Two sockets 3*a* are configured on each of two sidewalls of the impeller mounting shell 3 away from each other. Two ends of the impeller mounting shell 3 on the same sidewall are respectively configured with one of the two sockets 3*a*. The straight lines where the length direction of the two sockets 3*a* is located are parallel to each other. The straight lines where the length direction of the two sockets 3*a* is located are perpendicular to the air outlet direction of the impeller assembly 4. Two sidewalls of the two sockets 3*a* on the same side far away from each other are respectively configured with an insertion opening 3*a*1 configured for the connector 2 to be inserted into the socket 3*a*, wherein the insertion opening extends through the respective sidewall of the respective socket. One limiting bar 3*a*2 is integrally fixed on each of two sidewalls of the socket 3*a* adjacent to the insertion opening 3*a*1. The straight lines where the length direction of the limiting bars 3*a*2 is located are parallel to the straight lines where the length direction of the socket 3*a* is located. A limiting channel 3*a*3 in communication with the insertion opening 3*a*1 is formed between the limiting bar 3*a*2 and the bottom of the socket 3*a*.

Figure 3:
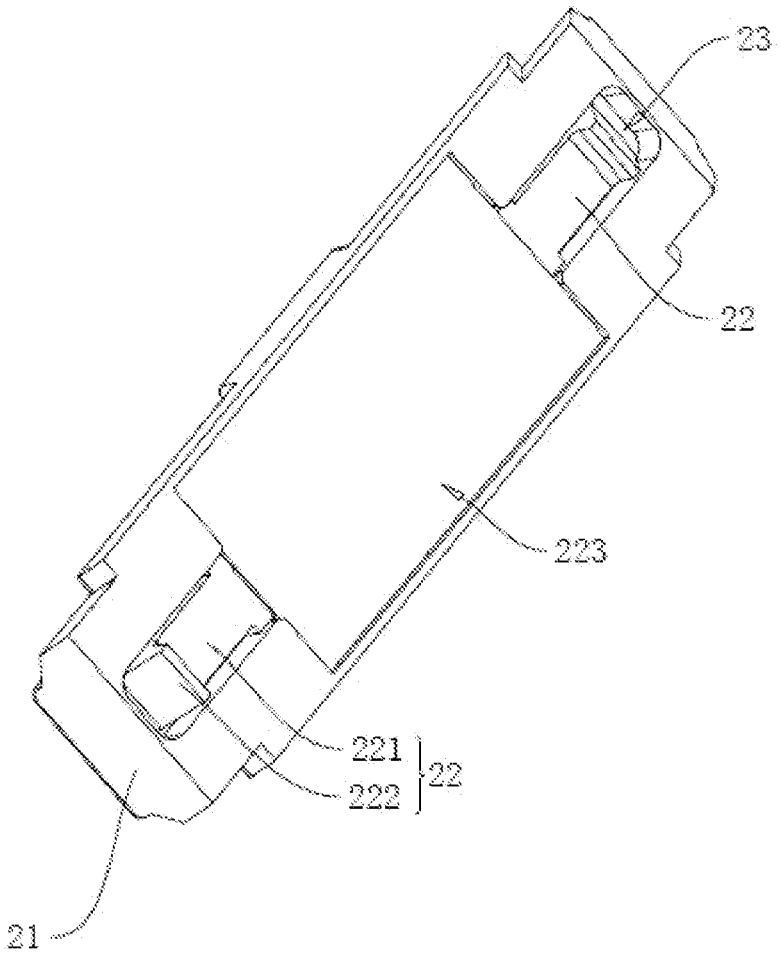
FIG. 3 is a schematic view of the connector in the combined fan structure of the present application.

Referring to FIG. 2 and FIG. 3, the connector 2 includes a connecting plate body 21 and two elastic stoppers 22 integrally fixed on the connecting plate body 21. Each of the two ends of the connecting plate body 21 far away from each other in the length direction is configured with an operating hole 23. The elastic stopper 22 includes an elastic flap 221 and a hook 222 integrally secured to the elastic flap 221. The first end of the elastic flap 221 is connected to the wall of the operating hole 23, and the hook 222 is arranged at the second end of the elastic flap 221. The two elastic flaps 221 are coplanar and parallel to the plane where the connecting plate body 21 is located. The two hooks 222 extend in the direction away from each other. The two hooks 222 extend to the outside of the operating holes 23 and are located on the same side of the connecting plate body 21. The two sides of the two hooks 222 far away from each other are inclined towards each other in the direction away from the two elastic flaps 221. A snapping groove 3*a*4 adaptive for the hook 222 is defined at an end of the bottom of the socket 3*a* away from the insertion opening 3*a*1.

Referring to FIG. 2 and FIG. 3, during inserting one end of the connector 2 into the socket 3*a* through the insertion opening 3*a*1, two sides of the connection plate body 21 slide in the limiting channel 3*a*3, wherein the limiting bars 3*a*2 position and guide the connecting plate body 21. The hook 222 slidingly abuts against the bottom of the socket 3*a* and pushes the elastic flap 221 in a direction away from the socket 3*a*, such that the elastic flap 221 is elastically deformed and store elastic potential energy. When the hook 222 moves to the snapping groove 3*a*4, the elastic flap 221 releases the elastic potential energy, such that the hook 222 is snapped into the snapping groove 3*a*4. The hook 222 is matched with the snapping groove 3*a*4 to limit the connecting plate body 21 from sliding out of the insertion opening 3*a*, so as to fix the one end of the connector 2 in the socket 3*a*. Another connector 2 is inserted and fixed in another socket 3*a* at the other sidewall and at the same end of the impeller mounting shell 3 in the same way, and then the two connectors 2 fixed on this sub-fan 1 are respectively inserted and fixed in two sockets 3*a* of another sub-fan 1, wherein the insertion openings 3*a*1 of the two sockets are open to the same side, thereby realizing the joint of two sub-fans 1. A plurality of sub-fans 1 can be connected in sequence to form a combined fan by repeating the above steps for many times. When the elastic flap 221 is manually bent in a direction away from the bottom of the socket 3*a* through the operating opening, the hook 222 is pulled out from the snapping groove 3*a*4, so as to pull the connector 2 out from the socket 3*a*, so that one sub-fan 1 can be detached from another sub-fan 1. The combination of different numbers of fans according to actual needs can therefore be easily realized.

Figure 4:
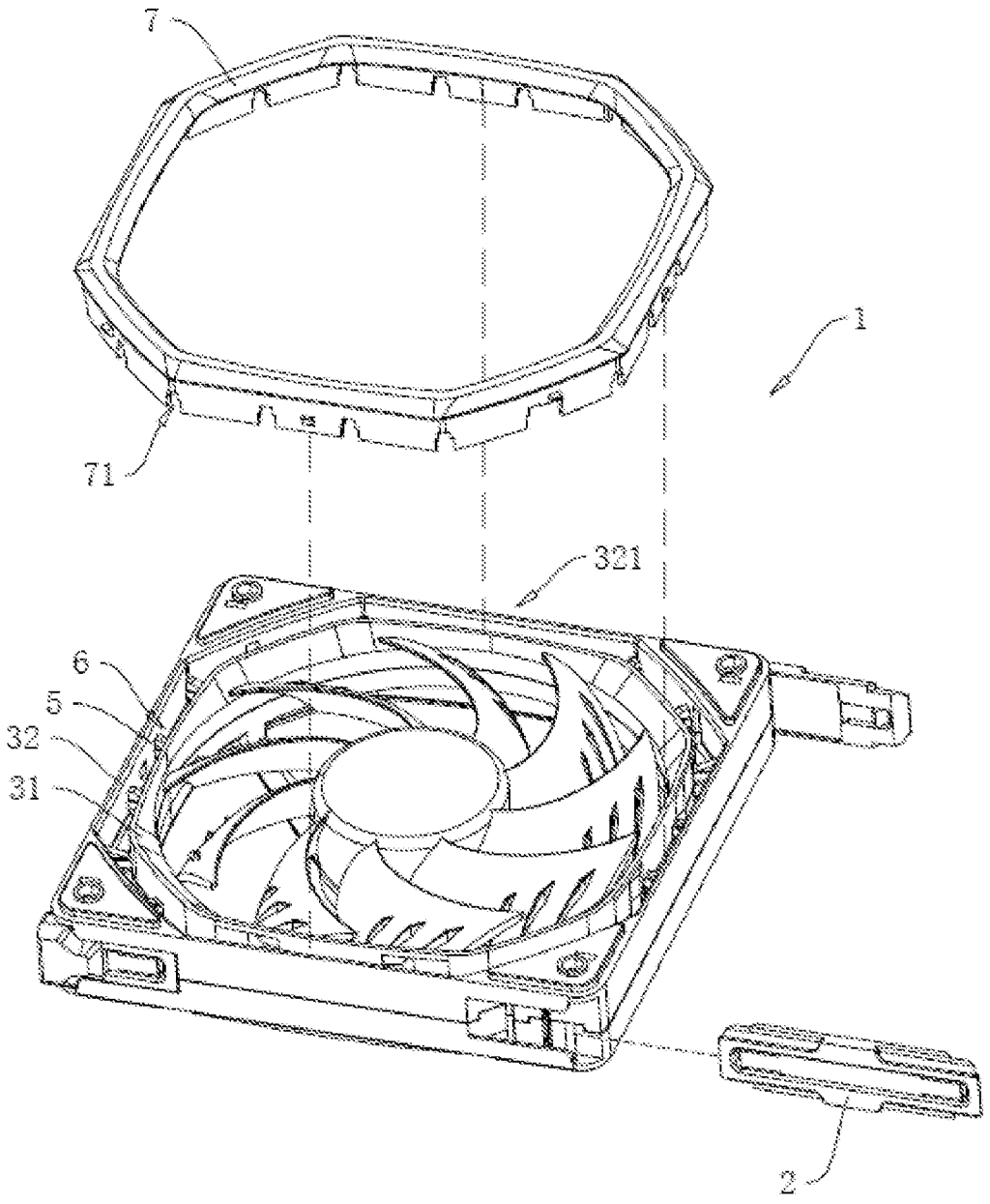
FIG. 4 is a front exploded schematic view showing the engagement between the lampshade and the impeller mounting shell of the combined fan structure of the present application.

Referring to FIG. 2 and FIG. 4, the impeller mounting shell 3 includes an inner mounting bracket 31 and an outer mounting housing 32. The impeller assembly 4 is arranged on the inner mounting bracket 31. The socket 3*a* is defined in the outer mounting housing 32. The outer mounting housing 32 is configured with a mounting hole 321. The inner mounting bracket 31 is arranged in the mounting hole 321. A plurality of connecting blocks 5 are disposed between the circumferential surface of the inner mounting bracket 31 and the inner wall of the mounting hole 321. The plurality of connecting blocks 5 are arranged at intervals around the inner wall of the mounting hole 321. Two ends of the connecting block 5 are respectively integrally fixed to the inner wall of the mounting hole 321 and the circumferential surface of the inner mounting bracket 31, and a closed and communicated wiring channel 6 is formed between the circumferential surface of the inner mounting bracket 31 and the wall of the mounting hole 321. The wires for connecting sub-fan 1 to operate can be wound in the wiring channel 6, which reduces the exposure of the wires, so that the entire structure of combined fan is neater. The connecting blocks 5 connect the inner mounting bracket 31 and the outer mounting housing 32, while supporting and protecting the wires in the wiring channel 6.

Figure 5:
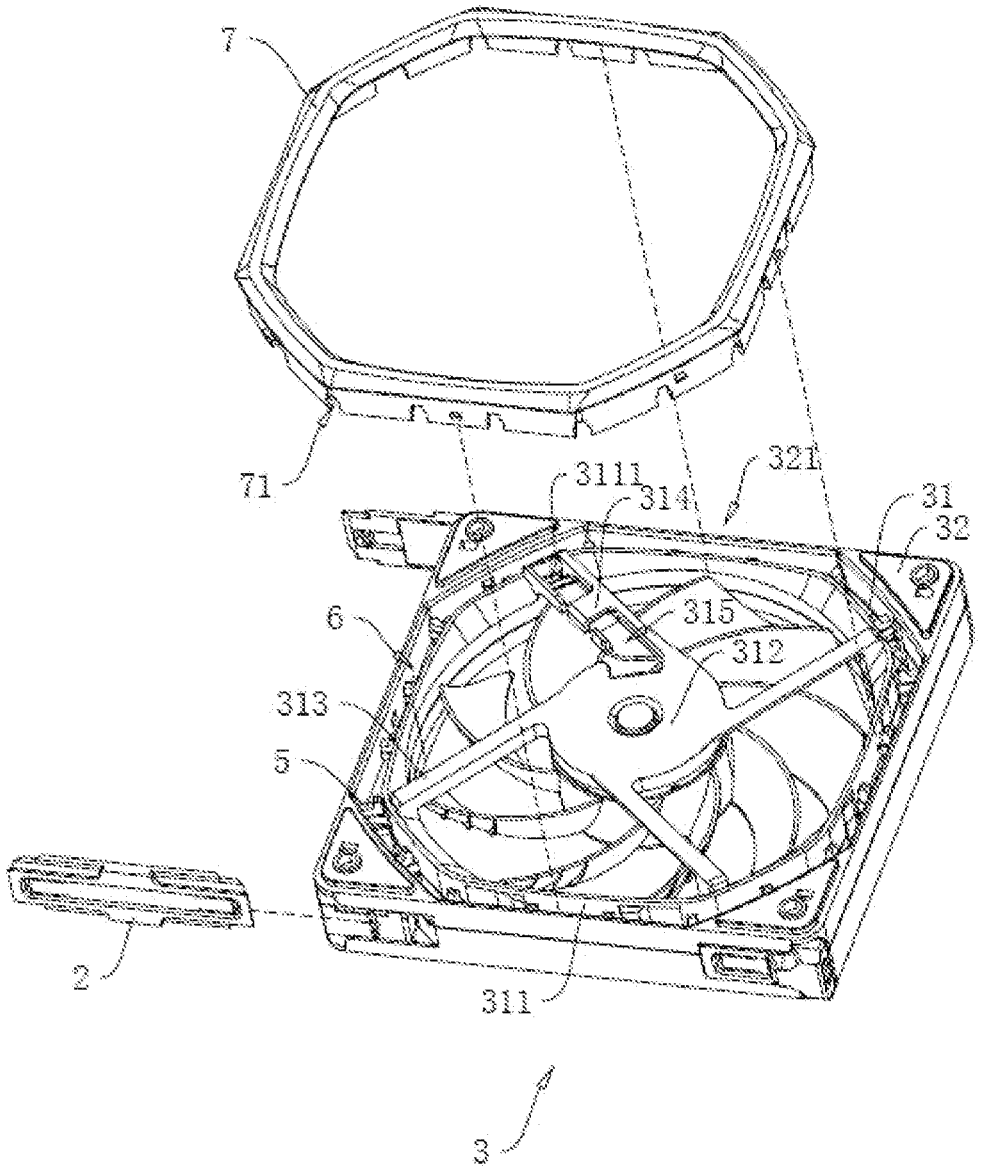
FIG. 5 is a reverse exploded schematic view showing the engagement between the lampshade and the impeller mounting shell of the combined fan structure of the present application.

Referring to FIG. 4 and FIG. 5, a blocking element is arranged in the wiring channel 6. The blocking element is configured as two annular lampshades 7. The two lampshades 7 respectively cover the wiring channel 6 at the positions close to the hole openings on both sides of the mounting hole 321. The lampshade 7 is clamped and fixed between the inner mounting bracket 31 and the inner wall of the mounting hole 321. A plurality of insertion notches 71 matched with the insertion blocks are configured at the end of the lampshade 7 close to the connecting block 5. When the lampshade 7 is mounted in the wiring channel 6, the plurality of insertion notches 71 are engaged with the plurality of connecting blocks 5 one by one, so that the lampshade 7 can be mounted more stably. The openings at two ends of the wiring channel 6 are sealed through the lampshade 7, so that dust and water stains are not easy to enter the wiring channel 6 to pollute and corrode the wires in the wiring channel 6, which improves the protection effect of the wires and the integrity of the sub-fan 1. Luminous light strips can be mounted in the wiring space. The light emitted by the luminous light strip can pass through the lampshade 7 to decorate the sub-fan 1, so that the overall appearance looks better.

Referring to FIG. 4 and FIG. 5, the inner mounting bracket 31 includes an outer mounting frame 311 and a mounting seat 312 configured for arrangement of the impeller assembly 4. The outer mounting frame 311 is coaxially disposed with the mounting hole 321. The mounting seat 312 is held at the center of the outer mounting frame 311 through three connecting rods 313 and a wire bridge 314. The impeller assembly 4 is mounted on the mounting seat 312 and located inside the outer mounting frame 311. The rotation axis of the impeller is coaxial with the axis of the mounting hole 321. The first end of the wire bridge 314 is connected to the mounting seat 312, and the second end of the wire bridge 314 is integrally connected to the outer mounting frame 311. A wire channel 315 is defined in the wire bridge 314. The outer mounting frame 311 is configured with a wire hole 3111 at the connection position with the wire bridge 314. The wire channel 315 is directly in communication with the wiring channel 6 through the wire hole 3111.

Figure 6:
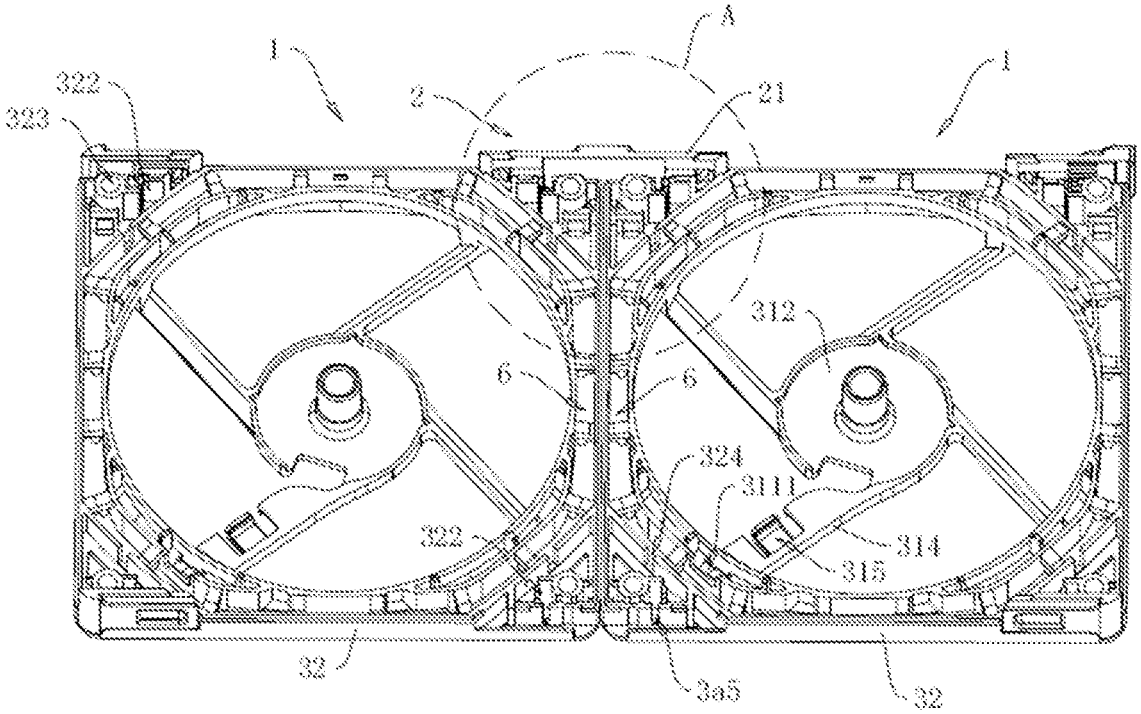
FIG. 6 is a schematic view of the wiring in the impeller mounting shell in a combined fan structure of the present application.
Figure 7:
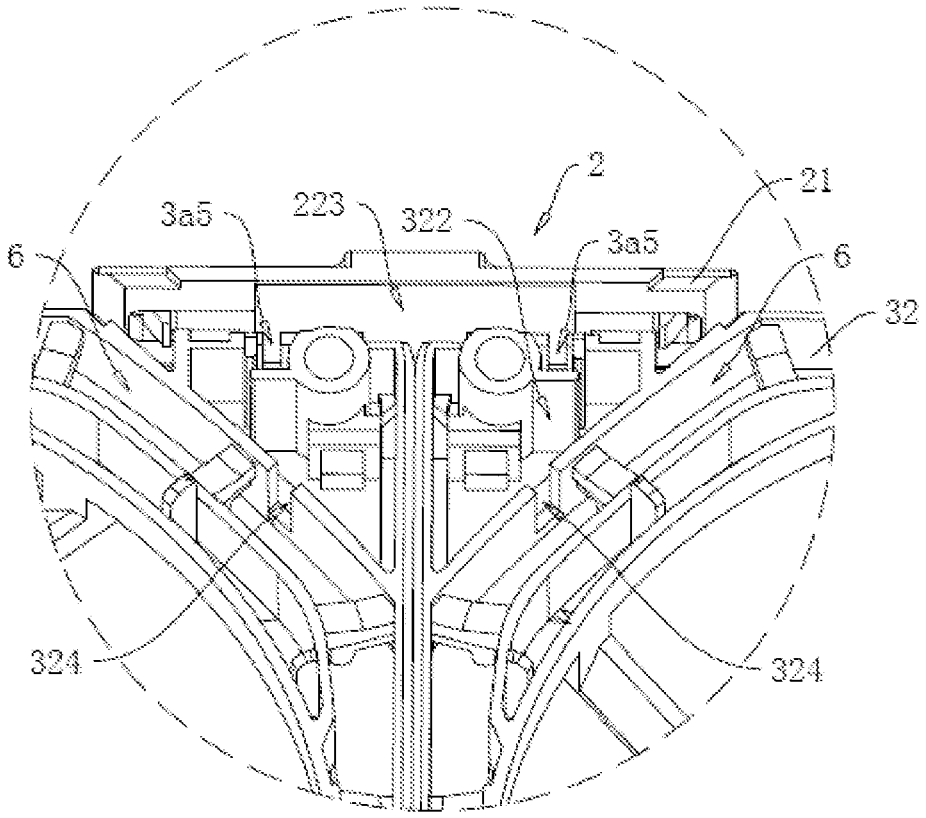
FIG. 7 is an enlarged view of part A of the combined fan structure of the present application.

Referring to FIG. 6 and FIG. 7, an accommodation chamber 322 is defined at each of the four corners of the outer mounting housing 32. A wire through hole 3*a*5 is configured at the bottom of the socket 3*a*. The wire through hole 3*a*5 is in communication with the accommodation chamber 322. A PCB mounting groove 223 is configured in the connecting plate body 21. The PCB mounting groove 223 and the hook are located on the same side of the connecting plate body 21. When two sub-fans 1 are connected with each other through the connector 2, the two wire through holes 3*a*5 in the two sub-fans 1 are in communication with the PCB mounting groove 223 simultaneously. A communicating hole 324 is configured in the sidewall of the accommodation chamber 322 close to the wiring channel 6. The communicating hole 324 is in communication with the wiring channel 6. In summary, in a sub-fan 1, the wire through hole 3*a*5 is in communication with the wiring channel 6 through the accommodation chamber 322. Any two accommodation chambers 322 are in communication with each other via the communicating hole 324 through the wiring channel 6. The wire channel 315 is directly in communication with the wiring channel 6 through the wire hole 3111. The wiring channels 6 in the two sub-fans 1 are connected with each other via the two adjacent wire through holes 3*a*5 through the PCB mounting groove 223.

The control wire enters the wiring channel 6 through a wire through hole 3*a*5 of a sub-fan 1, enters the wire bridge 314 through the wire hole 3111, is connected to the impeller assembly 4 through the wire channel 315, is arrived to the wiring channel 6 through the wire channel 315 and via the communicating hole 324, enters an accommodation chamber 322 close to the connector 2 and extends out of the wire through hole 3*a*5 in communication with this accommodation chamber 322, and arrives to the wire through hole 3*a*5 of the other sub-fan 1 through the PCB mounting groove 223. Most part of wiring of the whole wire is arranged inside the sub-fan 1. Therefore, the exposure of the wires is minimized, so that the overall beauty of the appearance of the sub-fan 1 is guaranteed and the wire is protected, meanwhile, the difficulty in sub-fan 1 installation due to the messy external wires is reduced. The accommodation chamber 322 provides mounting space for connecting terminal wires, adapters or other electronics. An elastic connection terminal can be pre-mounted at the wire through hole 3*a*5, wherein the first end of the elastic connection terminal located in the accommodation chamber 322 is connected to the wire in the wiring channel 6, and the second end thereof extends into the socket 3*a*. A PCB board (not shown in the drawings) for circuit connection can be mounted in the PCB mounting groove 223. When the two sub-fans 1 are connected with each other through the connector 2, the PCB board mounted in the PCB mounting groove 223 contacts and is connected to the connecting terminal wires mounted on the two sub-fans 1 simultaneously, so as to realize a circuit connection between the two sub-fans 1, so that the circuit connection between the two sub-fans 1 is simple and fast.

Referring to FIG. 6, the outer mounting housing 32 is configured with one screw hole 323 in each accommodation chamber 322, which is convenient to install the spliced combined fan at the corresponding position in the computer mainframe through screws.

The implementation principle of the combined fan structure in the embodiment of the present application is: two connectors 2 are respectively inserted and fixed in two sockets 3*a* of one sub-fan 1, wherein the insertion openings 3*a*1 of the two sockets are open to the same side. Then another sub-fan 1 is inserted and fixed on this sub-fan 1, so that the combination of a plurality of fans can be realized.

All of the above are preferred embodiments of the present application, and are not intended to limit the protection scope of the application. Therefore, all equivalent modification made according to the structure, shape and principle of the application should be covered by the protection scope of the application.

LIST OF REFERENCE SIGNS 1 sub-fan
2 connector
21 connecting plate body
22 elastic stopper
221 elastic connecting plate
222 hook
223 PCB mounting groove
23 operating hole
3 impeller mounting shell
3*a* socket
3*a*1 insertion opening
3*a*2 limiting bar
3*a*3 limiting channel
3*a*4 snapping groove
3*a*5 wire through hole
31 inner mounting bracket
311 outer mounting frame
3111 wire hole
312 mounting seat
313 connecting rod
314 wire bridge
315 wire channel
32 outer mounting housing
321 mounting hole
322 accommodation chamber
323 screw hole
324 communicating hole
4 impeller assembly
5 connecting block
6 wiring channel
7 lampshade
71 insertion notch

What is claimed is:

1. A combined fan structure, comprising a plurality of sub-fans and a connector connected between each two adjacent sub-fans of the plurality of sub-fans, wherein each of the plurality of sub-fans comprises an impeller mounting shell and an impeller assembly mounted on the impeller mounting shell, each of two sidewalls of the impeller mounting shell away from each other is respectively configured with two sockets, two ends of the impeller mounting shell at each of the two sidewalls of the impeller mounting shell each are respectively configured with one of the two sockets, two sidewalls of the two sockets away from each other are each configured with an insertion opening configured for the connector to be inserted into the insertion opening of a respective one of the two sockets, two sidewalls of each of the two sockets adjacent to the insertion opening are respectively configured with a limiting bar, a limiting channel is formed between the limiting bar and a bottom of each of the two sockets, and the limiting channel is in communication with the insertion opening;

a snapping groove is defined at the bottom of each of the two sockets, the connector comprises a connecting plate body and two elastic stoppers on the connecting plate body, two ends of the connecting plate body away from each other are respectively configured with an operating hole, each of the two elastic stoppers comprises an elastic flap and a hook connected to the elastic flap, a first end of the elastic flap is connected to a wall of the operating hole, the hook is disposed at a second end of the elastic flap and extends out of the operating hole, and when the connecting plate body is inserted in a respective one of the two sockets, the hook can be snapped in the snapping groove, wherein the impeller mounting shell comprises an inner mounting bracket and an outer mounting housing, the impeller assembly is disposed on the inner mounting bracket, the two sockets are defined at the outer mounting housing, the outer mounting housing is configured with a mounting hole, the inner mounting bracket is arranged in the mounting hole, the inner mounting bracket is connected to an inner wall of the mounting hole through a plurality of connecting blocks, and a closed and communicated wiring channel is formed between a circumferential surface of the inner mounting bracket and the inner wall of the mounting hole.

2. The combined fan structure according to claim 1, wherein a wire through hole is defined at the bottom of each of the two sockets, the wire through hole is in communication with the closed and communicating wiring channel, the connecting plate body is configured with a PCB mounting groove, the PCB mounting groove and the hook are arranged on a surface at a same side of the connecting plate body, and when two of the plurality of sub-fans are connected through the connector, two of the wire through holes in the two of the plurality of sub-fans are in communication with the PCB mounting groove.

3. The combined fan structure according to claim 2, wherein a blocking element is arranged in the closed and communicated wiring channel, the blocking element is clamped between the inner mounting bracket and the inner wall of the mounting hole, and the blocking element is configured to seal an opening of the closed and communicated wiring channel close to hole-openings on two sides of the mounting hole.

4. The combined fan structure according to claim 3, wherein the blocking element is configured as a lampshade in the closed and communicated wiring channel, and the lampshade is clamped between the inner mounting bracket and the inner wall of the mounting hole.

5. The combined fan structure according to claim 3, wherein the blocking element is configured with a plurality of insertion notches, and a sectional shape of each of the plurality of insertion notches is adaptive for each of the plurality of connecting blocks.

6. The combined fan structure according to claim 2, wherein the outer mounting housing is configured with an accommodation chamber close to a respective one of the two sockets, the wire through hole is in communication with the accommodation chamber, and a sidewall of the accommodation chamber close to the closed and communicated wiring channel is configured with a communicating hole in communication with the closed and communicated wiring channel.

7. The combined fan structure according to claim 1, wherein the inner mounting bracket comprises an outer mounting frame and a mounting seat disposed in the outer mounting frame, the impeller assembly is arranged on the mounting seat and located inside the outer mounting frame, an outer sidewall of the outer mounting frame is connected to the outer mounting housing through the plurality of connecting blocks, a wire bridge is disposed between the mounting seat and the outer mounting frame, the wire bridge is configured with a wire channel, the outer mounting frame is configured with a wire hole, an opening at an end of the wire hole is in communication with the closed and communicated wiring channel, an end of the closed and communicated wire channel close to the outer mounting frame is in communication with the wire hole.

8. The combined fan structure according to claim 1, wherein the impeller mounting shell is configured with a plurality of screw holes.

* * * * *